US011229815B1

(12) United States Patent
Duval

(10) Patent No.: US 11,229,815 B1
(45) Date of Patent: Jan. 25, 2022

(54) EXERCISE EQUIPMENT AND METHOD OF USING THE SAME

(71) Applicant: Douglas B. Duval, Brooklyn, NY (US)

(72) Inventor: Douglas B. Duval, Brooklyn, NY (US)

( * ) Notice: Subject to any disclaimer, the term of this patent is extended or adjusted under 35 U.S.C. 154(b) by 0 days.

(21) Appl. No.: 17/371,503

(22) Filed: Jul. 9, 2021

Related U.S. Application Data

(60) Provisional application No. 63/084,161, filed on Sep. 28, 2020, provisional application No. 63/055,999, filed on Jul. 24, 2020.

(51) Int. Cl.
*A63B 21/068* (2006.01)
*A63B 21/00* (2006.01)
*A63B 23/12* (2006.01)

(52) U.S. Cl.
CPC ..... *A63B 21/00047* (2013.01); *A63B 21/068* (2013.01); *A63B 21/4035* (2015.10); *A63B 23/1236* (2013.01)

(58) Field of Classification Search
CPC ..... A63B 21/00047; A63B 21/068; A63B 21/078; A63B 21/0783; A63B 21/4035; A63B 23/1227; A63B 23/1236
See application file for complete search history.

(56) References Cited

U.S. PATENT DOCUMENTS 5,141,480 A * 8/1992 Lennox ..... A63B 21/078 482/104
6,695,754 B1 * 2/2004 Gazzolo ..... A63B 23/12 482/141
7,125,371 B2 * 10/2006 Henderson ..... A63B 21/068 482/142
7,717,837 B2 * 5/2010 Florczak ..... A63B 21/4035 482/143
7,753,830 B1 * 7/2010 Marsh ..... A63B 23/03525 482/142

(Continued)

OTHER PUBLICATIONS

MoveStrong, "Pushup bar—MoveStrong Functional Fitness Equipment", Mar. 15, 2011, www.youtube.com/watch?v=7gfsR1IN4j4.

(Continued)

*Primary Examiner* — Joshua Lee
(74) *Attorney, Agent, or Firm* — Leason Ellis LLP

(57) ABSTRACT

An exercise device for performing incline push-ups includes a base and a pair of upright frame members connected at their bottoms to the base. The exercise device includes a pair of bar support assemblies that movably travel along the upright frame members. Each bar support assembly includes a hollow base sleeve that surrounds one upright frame member and an arm that extends outwardly from the hollow base sleeve at an angle. The arm has a plurality of spaced notches formed therein. The bar support assembly includes an insert that slidingly travels within the hollow interior of the arm. The insert is biased by a biasing element that is disposed between the arm and the insert and the insert is biased in a direction toward the hollow base sleeve. The bar support assembly further includes a plurality of lock pieces that are pivotally attached to both the arm and the insert. Each lock piece is disposed at least partially within one respective notch of the arm and movable between an unlocked position and a locked position.

14 Claims, 15 Drawing Sheets

(56) References Cited

U.S. PATENT DOCUMENTS

| | | | | |
|---|---|---|---|---|
| 7,896,786 | B1 * | 3/2011 | Osbourne | A63B 23/0355 482/122 |
| 8,057,361 | B2 * | 11/2011 | McBride | A63B 23/03575 482/15 |
| 9,216,314 | B2 * | 12/2015 | Chen | A63B 21/0783 |
| 9,517,382 | B2 * | 12/2016 | Payne | A63B 23/0233 |
| 9,675,829 | B1 * | 6/2017 | Katz | F16B 7/10 |
| 9,895,564 | B1 * | 2/2018 | Katz | A63B 23/1218 |
| 2001/0004624 | A1 * | 6/2001 | Cournoyer | A63B 21/4035 482/141 |
| 2008/0045390 | A1 * | 2/2008 | Harms | A63B 23/12 482/141 |
| 2013/0237394 | A1 * | 9/2013 | Fowler | A63B 23/1236 482/142 |
| 2014/0187391 | A1 * | 7/2014 | Kelly | A63B 21/0783 482/104 |
| 2014/0315700 | A1 * | 10/2014 | Stallman | A63B 21/00047 482/141 |
| 2016/0008656 | A1 * | 1/2016 | Critelli | A63B 23/0205 482/95 |
| 2016/0074695 | A1 * | 3/2016 | Lee | A63B 21/0783 482/104 |
| 2016/0271444 | A1 * | 9/2016 | Payne | A63B 21/4035 |
| 2017/0056711 | A1 * | 3/2017 | Dalebout | A63B 22/0007 |
| 2017/0056715 | A1 * | 3/2017 | Dalebout | A63B 23/1236 |
| 2020/0222739 | A1 * | 7/2020 | George | A63B 1/00 |
| 2020/0298055 | A1 * | 9/2020 | Sneathen | A63B 21/00047 |

OTHER PUBLICATIONS

Bodybuilding.com, "Bar Push-up Smith Machine—Excise Guide," Aug. 21, 2016, www.youtube.com/watch?v=wBAox4aobw4.

* cited by examiner

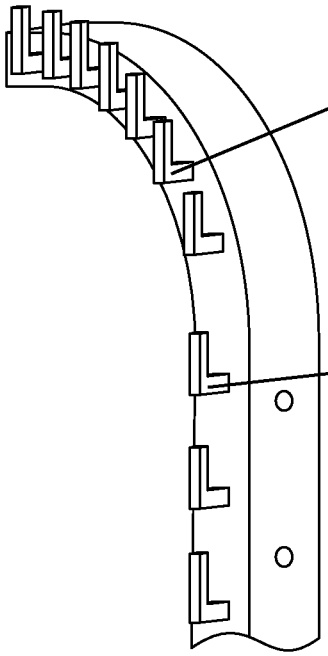
Fig. 3
Fig. 4A
Fig. 4B
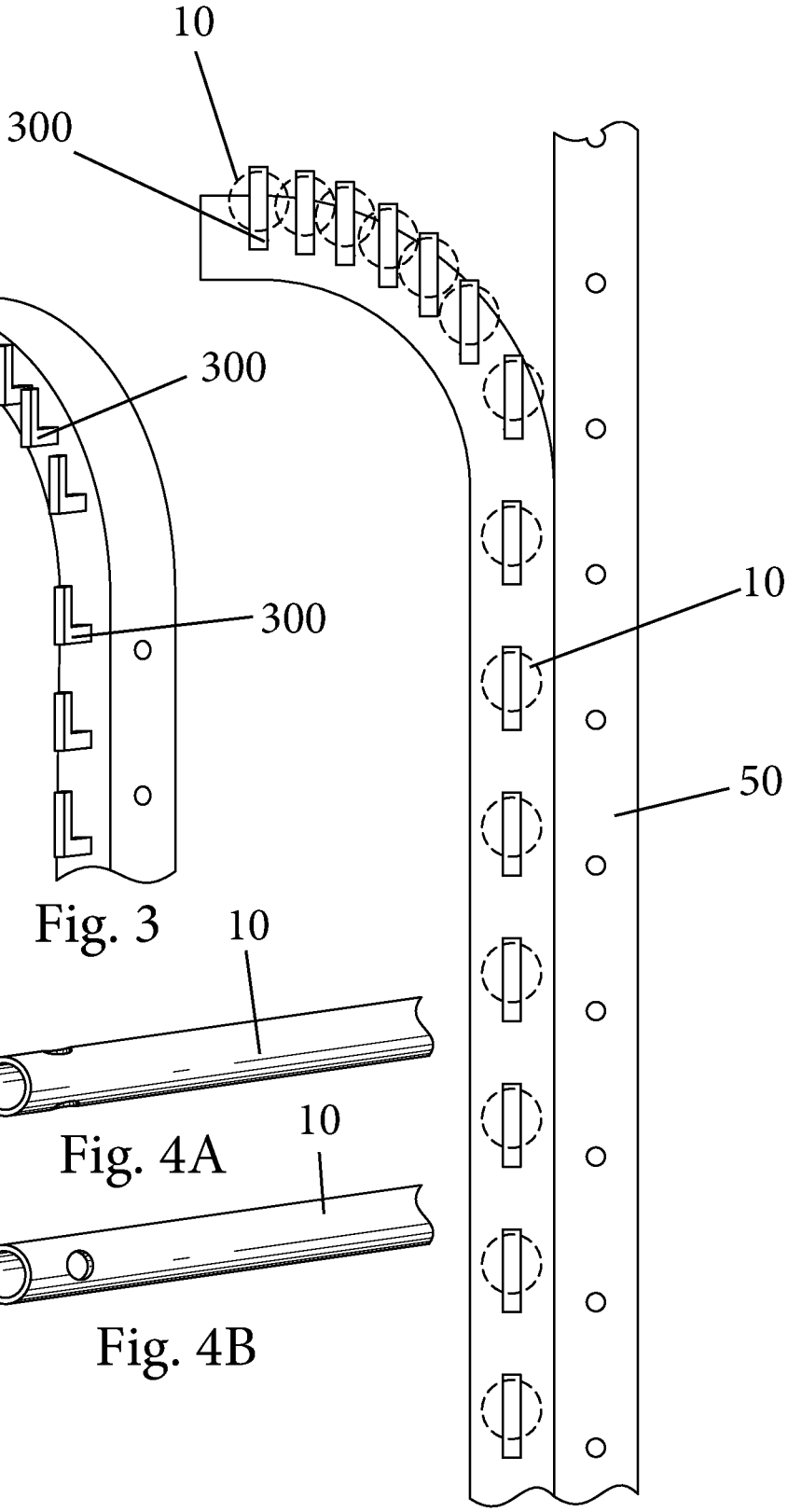
Fig. 2

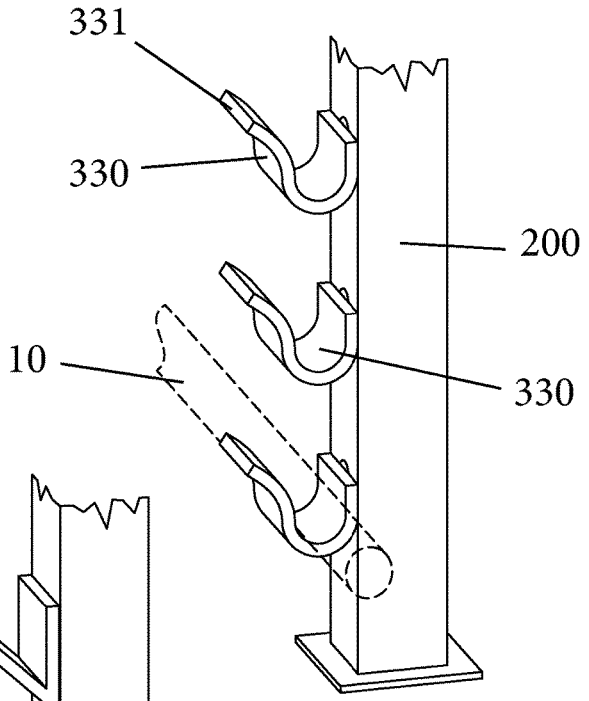
Fig. 9
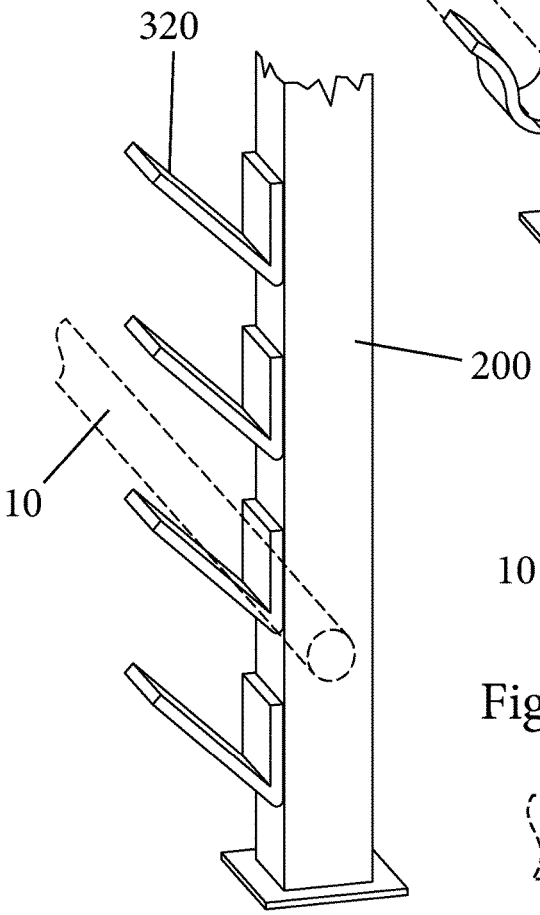
Fig. 8
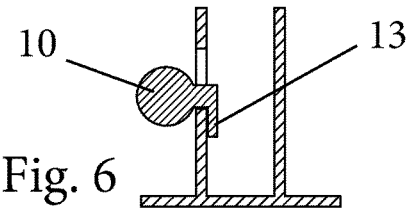
Fig. 6
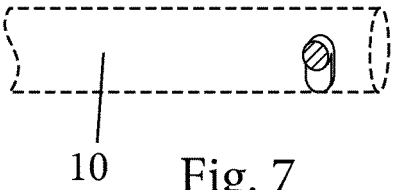
Fig. 7
Fig. 5
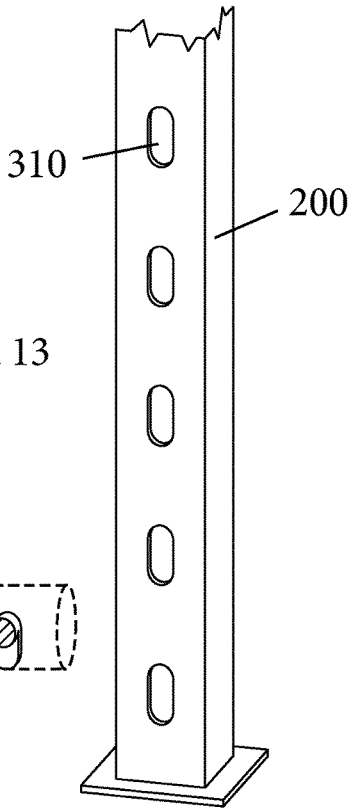

EXERCISE EQUIPMENT AND METHOD OF USING THE SAME

CROSS REFERENCE TO RELATED APPLICATION

The present application claims priority to and the benefit of U.S. patent application No. 63/084,161, filed Sep. 28, 2020 and U.S. patent application No. 63/055,999, filed Jul. 24, 2020, each of which is hereby expressly incorporated by reference in its entirety.

TECHNICAL FIELD

The present application is generally directed to exercise equipment and more particularly, to a piece of exercise equipment that is configured to allow a user to perform an incline push-up of varying and selectable difficulty and as the user becomes stronger and more accustomed to performing push-ups, the user can ultimately graduate to performing traditional push-ups on a horizontal ground plane.

BACKGROUND

A push-up is a very common exercise that is introduced to people at an early age, such as grammar school gym class. As is well known, a push-up is a common calisthenics exercise beginning from the prone position. By raising and lowering the body using the arms, push-ups exercise the pectoral muscles, triceps, and anterior deltoids, with ancillary benefits to the rest of the deltoids, serratus anterior, coracobrachialis and the midsection as a whole.

In performing a traditional push-up, the person gets down on all fours, placing their hands slightly wider than their shoulders. The person's arms and legs are then straightened. The body is lowered until the person's chest nearly touches the floor. The person then pauses and pushes himself or herself back up to complete one push-up. The exercise is then repeated.

Push-ups are difficult for many people because they depend on your bodyweight. Push-ups can also be hard if the person lacks core strength. Therefore, how easily a person can perform a push-up can say a lot about the person's overall fitness, since the move requires serious body control, strength and muscular endurance. In fact, a person has to be strong enough to lift between 50 to 75 percent of their body weight in order to perform a traditional push-up.

Since the push-up is a difficult exercise and it can take time for a person to see progress, many people unfortunately give up after their initial failure with trying to perform more than one push-up.

It would therefore be beneficial if assistance can be given to people who are new to performing traditional push-ups and/or have great difficulty in performing traditional push-ups.

SUMMARY exercise device for performing incline push-ups includes a base and a pair of upright frame members connected at their bottoms to the base. The exercise device includes a pair of bar support assemblies that movably travel along the upright frame members. Each bar support assembly includes a hollow base sleeve that surrounds one upright frame member and an arm that extends outwardly from the hollow base sleeve at an angle. The arm has a plurality of spaced notches formed therein. The bar support assembly includes an insert that slidingly travels within the hollow interior of the arm. The insert is biased by a biasing element that is disposed between the arm and the insert and the insert is biased in a direction toward the hollow base sleeve. The bar support assembly further includes a plurality of lock pieces that are pivotally attached to both the arm and the insert. Each lock piece is disposed at least partially within one respective notch of the arm and movable between an unlocked position and a locked position.

BRIEF DESCRIPTION OF THE DRAWING FIGURES

FIG. 2 is a side elevation view of an upright frame member that is part of the exercise device;

FIG. 3 is a view of an upper portion of the upright frame member;

FIG. 4A is a perspective view of one end of an exercise bar according to one embodiment;

FIG. 4B is another perspective view of the one end of the exercise bar;

FIG. 5 is a perspective view of a lower portion of an upright frame member according to another embodiment;

FIG. 6 is a cross-sectional view thereof;

FIG. 7 is a view of the exercise bar for use with the upright frame member of FIG. 5;

FIG. 8 is a perspective view of a lower portion of an upright frame member according to another embodiment;

FIG. 9 is a perspective view of a lower portion of an upright frame member according to another embodiment;

DETAILED DESCRIPTION OF CERTAIN EMBODIMENTS

Figure 1:
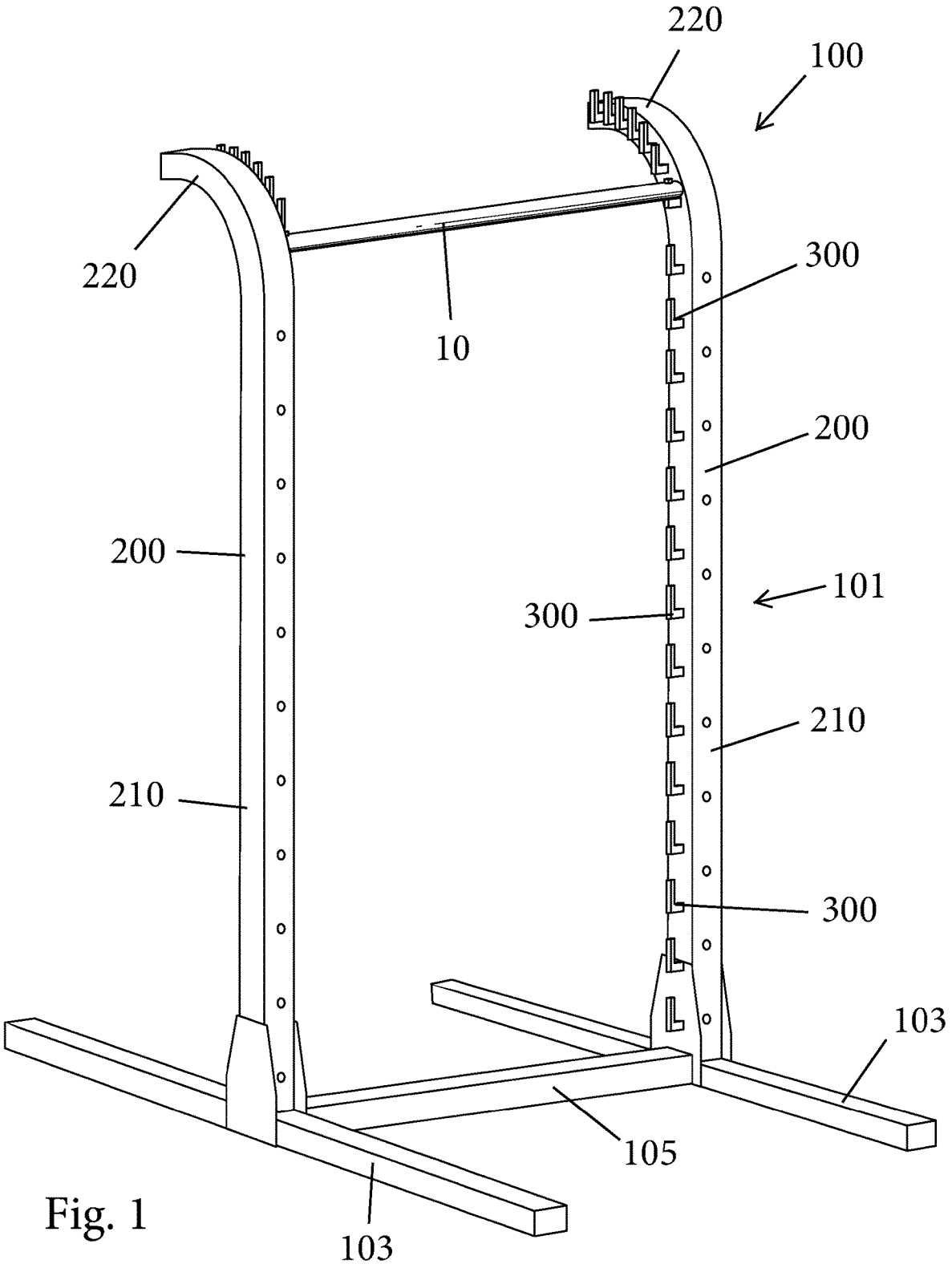
FIG. 1 is a perspective view of an exercise device for performing an incline push-up according to a first embodiment.

The present disclosure is generally directed to a piece of exercise equipment (exercise device) that is configured to assist a user in performing push-ups and more particularly, allows the user to perform (incline) push-ups of varying difficulty depending upon the setting selected by the user. As described herein, the piece of exercise equipment allows the user to perform an incline push-up of varying and selectable difficulty and as the user becomes stronger and more accustomed to performing push-ups, the user can ultimately graduate to performing traditional push-ups on a horizontal ground plane. The easiest push-up is performed with the user in a standing position and leaning only slightly forward to grasp a horizontal bar for performing the push-ups and the user can continuously adjust the angle of body incline to increasingly make the push-ups more difficult until the user reaches the traditional push-up position.

Incline Push-Ups Performing push-ups on an incline changes the strain that the gravity force vector places on the user's body. In other words, changing the angle so that the user is higher than the ground surface, makes it easier for the person to perform the movement. Since an incline push-up shares the same body position and movement pattern with the classic push-up, it works the same muscles in a similar way. It will be appreciated that the incline push-up exercise is more adaptable to the user's current fitness level. As mentioned, the greater the angle of the user s body to the ground, the easier the exercise becomes. As the person becomes stronger, the person can move his or her hands progressively closer to the floor making the exercise harder to perform.

There are several ways to modify or progress the incline push-up. First, the angle can be changed. As noted above, a user can perform incline push-ups at nearly any angle: the steeper the incline, the easier the move becomes. People new to strength training can even perform the incline push-up with their hands on the vertical surface of a wall. Second, change the temp of the exercise. The slower a person performs any exercise including the incline push-up the greater the person's muscles' time under tension will be, and the more challenging the exercise will become. Third, add some instability. To increase the challenge to the person's balance and core, lift one foot off of the ground as the move is performed, alternating legs every rep.

As mentioned previously, incline push-ups work the same muscles as classic push-ups, but are easier to perform, making them more accessible to beginners. Also, like classic push-ups, they hammer a muscle group that typically gets off easy with other chest exercises like the bench press, namely: the person's core.

Exercise Device (First Embodiment)

FIGS. 1-4B illustrate an exercise device 100 (piece of exercise equipment) according to one embodiment. The exercise device 100 is preferably intended to be a freestanding structure that can be positioned in a residential setting (a room in a house) or it can be positioned in a commercial setting, such as a gym. The exercise device 100 thus has a frame 101 that allows it to stand upright on a floor (ground surface).

The frame 101 can include a base that sits on the ground and provides sufficient stability to the exercise device 100. The base can constitute a pair of horizontal base members 103 that are spaced apart and rest on the ground. Typically, these horizontal base members 103 are made of metal and provide weight to the base. One or more cross support members 105 are provided for stability and extend between the base members 103.

The frame also includes a pair of upright frame members 200 that extend upwardly from and are integrally attached to the base members 103. One upright frame member 200 extends upwardly from one horizontal base member 103 and the other upright frame member 200 extends upwardly from the other horizontal base member 103. The two upright frame members 200 are opposite one another with an open space formed between for reception of a bar 10 and/or the user's body.

In a traditional weightlifting cage, the uprights frame members 200 are completely linear from one end to the other end. In the present disclosure, the upright frame members 200 are not completely linear but instead have a lower section 210 that is linear and an upper section 220 that protrudes out of the plane that contains the lower section 210. In other words, each upright frame member 200 can be considered to have a first section connected to the base and a second section that is coupled to the first section but extends outwardly (e.g., forwardly) thereof.

In one embodiment, the lower section 210 comprises a linear section and the upper section 220 comprises a non-linear section. The non-linear (upper) section can take any number of different forms. For example, the non-linear section 220 can have an arcuate (curved) shape as shown in FIG. 1. This curved section extends outwardly (forwardly) toward the user who is located in front of the exercise device 100. It will also be appreciated that the curved section could curve outwardly away from the user since in this alternative position, the user can still grasp the exercise bar 10 as shown in FIG. 1.

Figure 11:
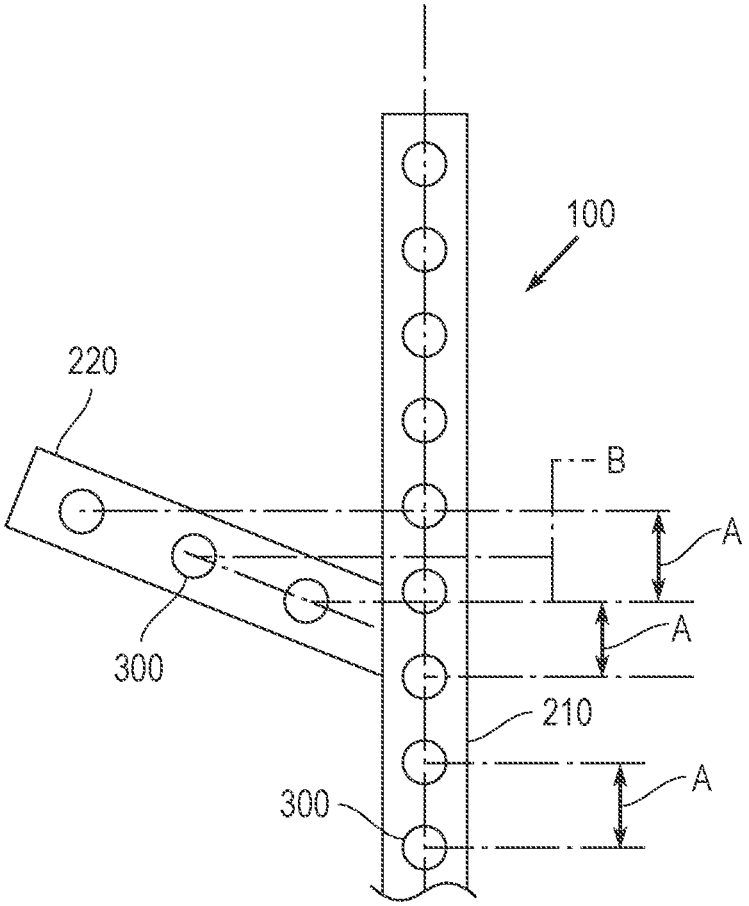
FIG. 11 is a partial view of a top end portion of the upright frame member according to one embodiment.

In another embodiment shown in FIG. 11, the upper section 220 can also be a linear section that is coupled to the lower section 210 at an angle and is not coaxial with the lower section 210. In the configuration, the upright frame member 200 has a Y-like shape. In FIG. 11, the dimension A can be 2 inches and the dimension B can be 1 inch.

It will be appreciated that the lower section 210 and the upper section 220 can be part of a single integral structure or alternatively, they can constitute two separate parts that are coupled (welded, fastened, etc.) to one another.

FIG. 2 also shows that the upright frame member 200 can be joined to a traditional vertical support member 50 that is part of the frame and is attached to the base (not shown). The vertical support member 50 can be located behind the upright frame member 200. The upright frame member 200 and the vertical support member 50 can be attached to one another by traditional techniques, such as welding.

Pole Attachment Locations

Along each upright frame member 200 there are a plurality of identifiable, discrete pole attachment locations, generally identified at 300, that define locations at which the exercise bar 10 can be securely attached to the upright frame members 200 such that the exercise bar 10 extends across the two upright frame members 200. When properly secured to the two upright frame members 200 at one of the pole attachment locations, the exercise bar 10 is oriented horizontal and parallel to the ground surface on which the base rests. The user then grasps the exercise bar 10 with his or her hands and performs an incline push-up. As the user gains strength, the user then lowers the exercise bar 10 to the next lower pole attachment location 300 which is at a reduced angle relative to the horizontal floor plane and is therefore more challenging.

The pole attachment locations 300 are thus located along both the lower section 210 and the upper section 220. Each pole attachment location 300 includes a means for retaining the exercise bar 10 in a manner in which the user's weight can be applied thereto. Indicia, such as text and/or numbering, can be provided to uniquely identify the individual pole attachment locations 300. For example, the locations 300 can be consecutively numbers or lettered or identified by an angle value representing the angle relative to the horizontal ground surface. In this way, the exercise bar 10 can be quickly attached to a given pole attachment location, such as a location "5" or an angle "60°" along each of the upright frame member 200.

It will be readily understood in view of the figures that the spacing of the pole attachment locations 300 differ along the linear section 210 compared to the non-linear section 220. In particular, along the linear section 210 that extend vertically relative to the ground surface, the pole attachment locations 300 are located one on top of the other and can have a uniform spacing therebetween or a non-uniform spacing. In the illustrated embodiment, the spacing is uniform in this linear section 210 with each pole attachment location being spaced a first distance or first pitch (distance or pitch X) from an adjacent pole attachment location. In the illustrated embodiment, along the non-linear section 220 that is curved, the pole attachment locations 300 are spaced a second distance or second pitch (distance or pitch Y) apart from one another. The distance X being greater than the distance Y. However, as shown in alternative embodiments that are illustrated herein, the distance Y can be the same as the distance X.

It will be understood that when the user places the exercise bar 10 at one pole attachment location, an angle is defined between the exercise bar 10 and the horizontal floor (ground) plane. As mentioned, the closer this angle is to 90 degrees (which is a position at which the user is standing fully upright on the ground surface), the easier it is to perform the push-up. As this angle is reduced and approaches 0 degrees (which is defined as the horizontal floor plane), the push-up becomes more difficult. Thus, as the exercise bar 10 is lowered along the upright frame members 200, the push-ups become increasingly harder to perform due to the change in the angle of the incline (of the user's body).

In one embodiment shown in FIG. 11, the exercise device 100 is configured to permit the user to perform incline push-ups from angles starting at 80 degrees from the horizontal floor plane and going all the way down to 10 degrees from then horizontal floor plane (however the device can be configured to allow the user to perform an incline push-up between 90 degrees and 0 degrees). As shown, in FIG. 11, each upright frame member 200 includes two linear sections, namely, a first linear section that comprises upper section 220 and a second linear section that comprises lower section 210. The upper section 220 is attached to the lower section 210 at an angle and extends outwardly (forwardly) therefrom. The upper section 220 can be considered to be a bar attachment arm and can be used using traditional techniques, such as the use of fasteners or the like. As explained below, this embodiment is designed to have a 1 inch vertical pitch throughout the entire device. More specifically and as illustrated, there is a 1 inch vertical adjustment (vertical pitch) in the upper section 220, while the main vertical support (lower section 230) has a 2 inch vertical pitch and the upper section 220 can have three (3) 1 inch vertical pitch locations (pole attachment locations).

Figure 12:
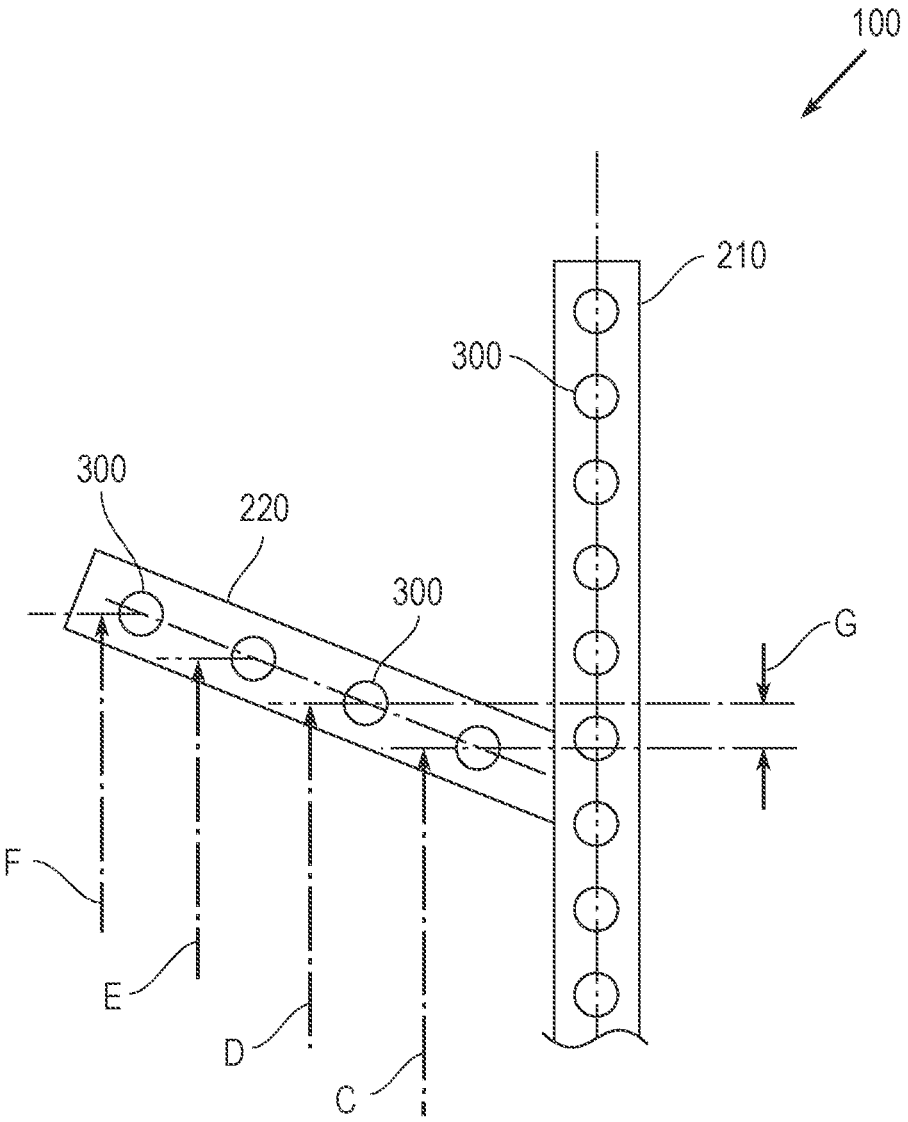
FIG. 12 is a partial view of a top end portion of the upright frame member according to another embodiment.

FIG. 12 shows another embodiment in which instead of a 1 inch vertical adjustment, the device has 0.5 inch vertical adjustment. In other words, when the user starts at the first position (highest position) on the upper section 220 and then moves to the second position on the upper section 220, the exercise bar 10 has dropped 0.5 inch. Other vertical pitch values are equally possible. In addition, the vertical adjustment values can be different along the arm.

In FIG. 12, the height C can be 18.5 inches; the height D can 19 inches; the height E can be 19.5 inches; and the height F can be 20 inches. The distance G can be 0.5 inch. The distance G can be the same between each of the pole attachment locations 300 as shown; however, in another embodiment, the pole attachment locations 300 can be grouped into two or more sets with the distance G of a first set being a first value and the distance G of a second set being a different second value.

Figure 13:
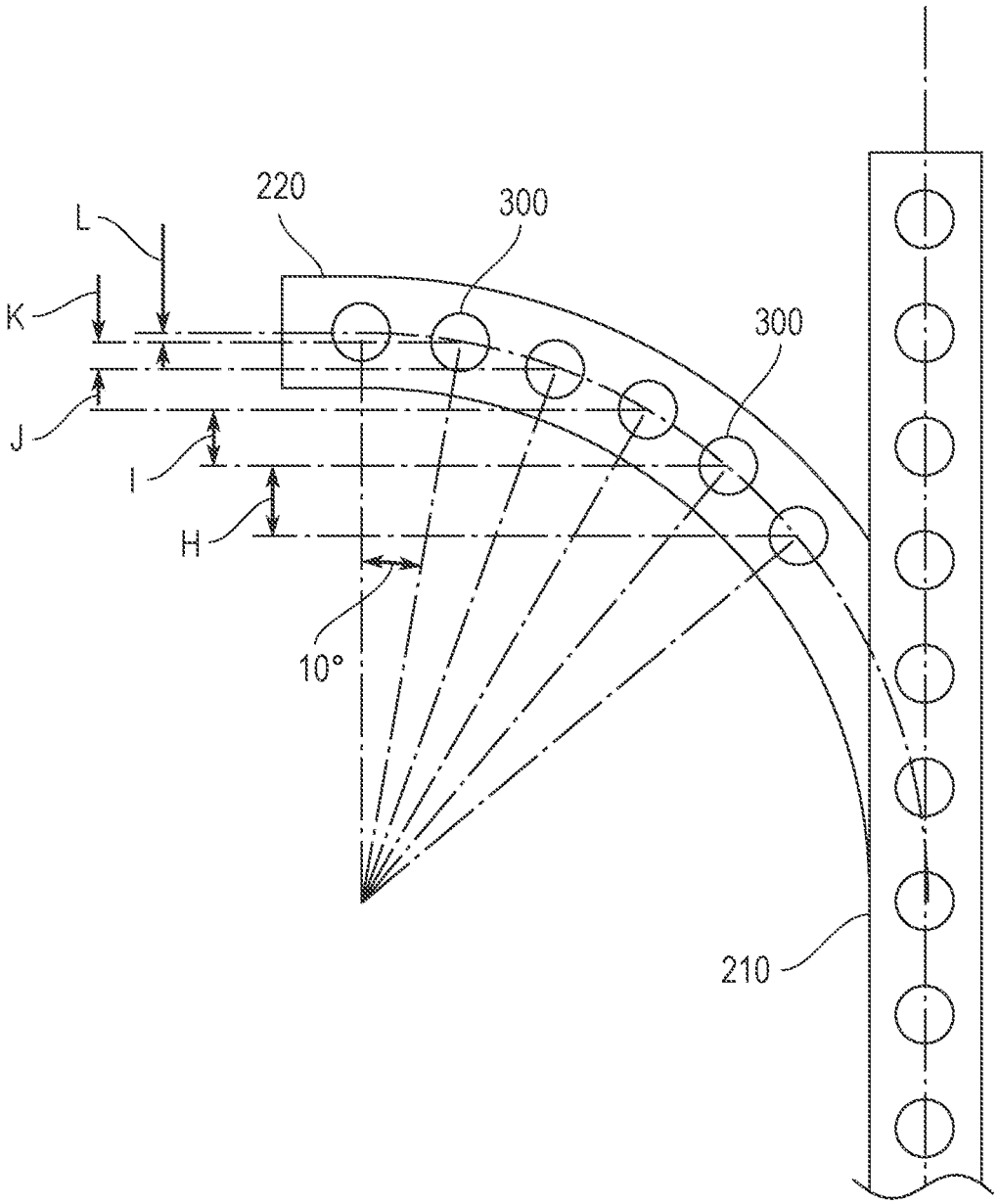
FIG. 13 is a partial view of a top end portion of the upright frame member according to another embodiment.

FIG. 13 shows additional details of exemplary equipment. FIG. 13 shows the curved upper section 220 with pole attachment locations 300. In FIG. 13, the distance H is 1.23 inches; the distance I is 1.00 inch; the distance J is 0.74 inch; the distance K is 0.45 inch; and the distance L is 0.15 inch.

It will be appreciated that the aforementioned values are only exemplary in nature and the dimensions can differ from the above values.

Pole Attachment Locations

In one embodiment, shown in FIG. 5, there is an opening 310 at each pole attachment location along each upright frame member 200 for reception of one end of the exercise bar 10. As shown in the figure, the exercise bar 10 can have hook elements 11 at its two ends that are received within the openings 310 to securely attach the exercise bar 10 to the pair of upright frame members 200 at the selected post attachment location. The user simply inserts the hook elements 11 into the openings 310 to effectuate a connection between the exercise bar 10 and the pair of upright frame members 200. In this embodiment, the exercise bar 10 can include a hook structure 13 that is received within the opening 310.

In other embodiments, there is a hook or cradle element at each of the pole attachment locations for securely attaching the exercise bar 10 to the pair of upright frame members 200. For example, FIG. 8 shows a plurality of hook members 320 formed along the upright frame member 200 in spaced relationship. The hook members 320 can generally be V-shaped and each has a trough or valley into which the exercise bar 10 is received and held between the two legs of the hook member 320. The top of the forward leg can be higher than the top of the rear leg that is secured to the upright frame member 200.

For example, FIG. 9 shows a plurality of cradle elements 330 formed along the upright frame member 200 in spaced relationship. The cradle element 330 can be generally U-shaped and includes a concave shaped bottom into which the exercise bar 10 is received and held. A top forward edge 331 can be flared and bent outwardly to prevent the exercise bar 10 from becoming dislodged from the cradle element 330.

Figures 14A, 14B, 14C:
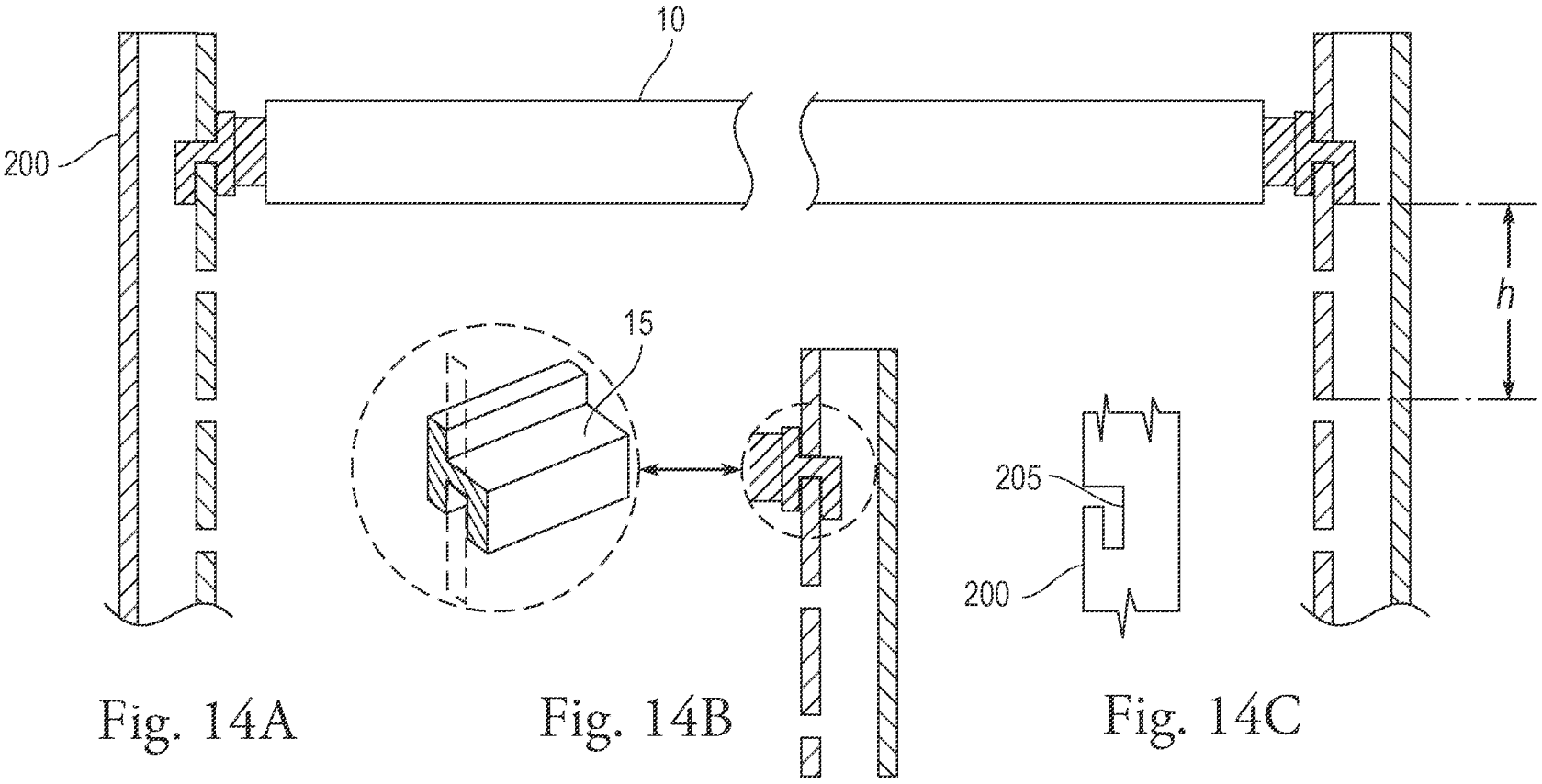
FIGS. 14A-14C illustrate a horizontal slot attachment mechanism for attaching the exercise bar to the upright frame members.
Figure 15:
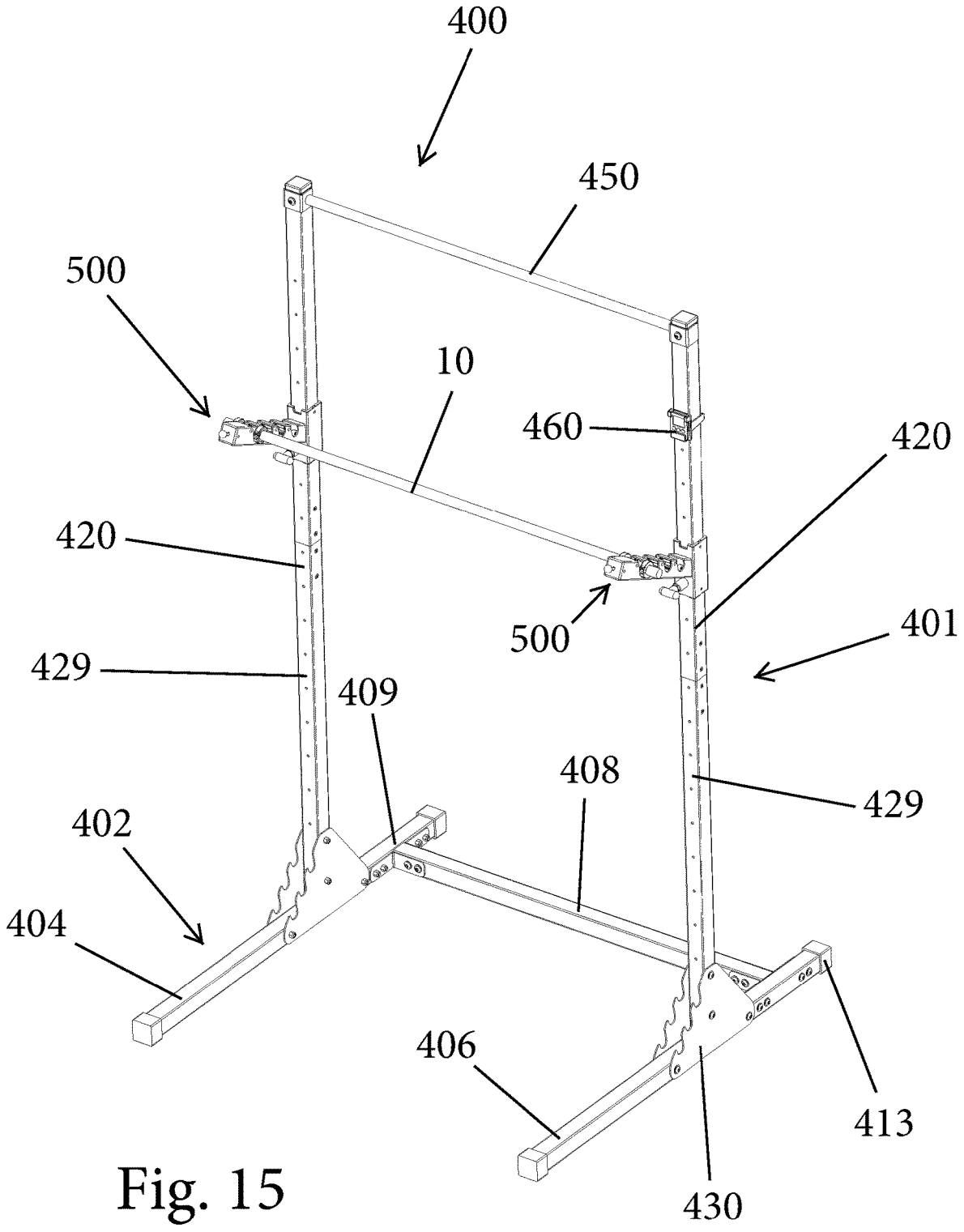
FIG. 15 is a front perspective view of an exercise device for performing an incline push-up according to a second embodiment.
Figure 16:
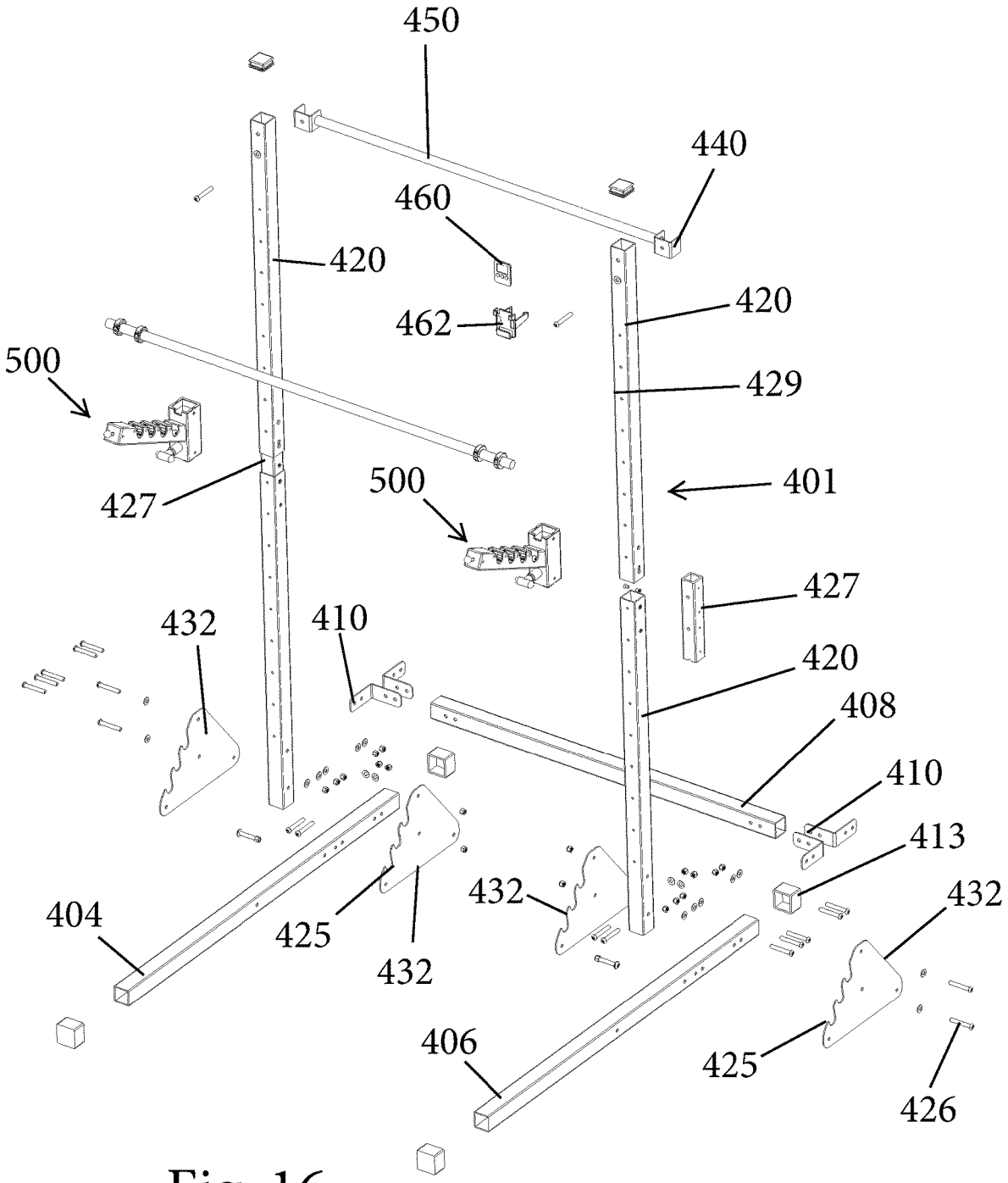
FIG. 16 is an exploded view of the exercise device.
Figure 17:
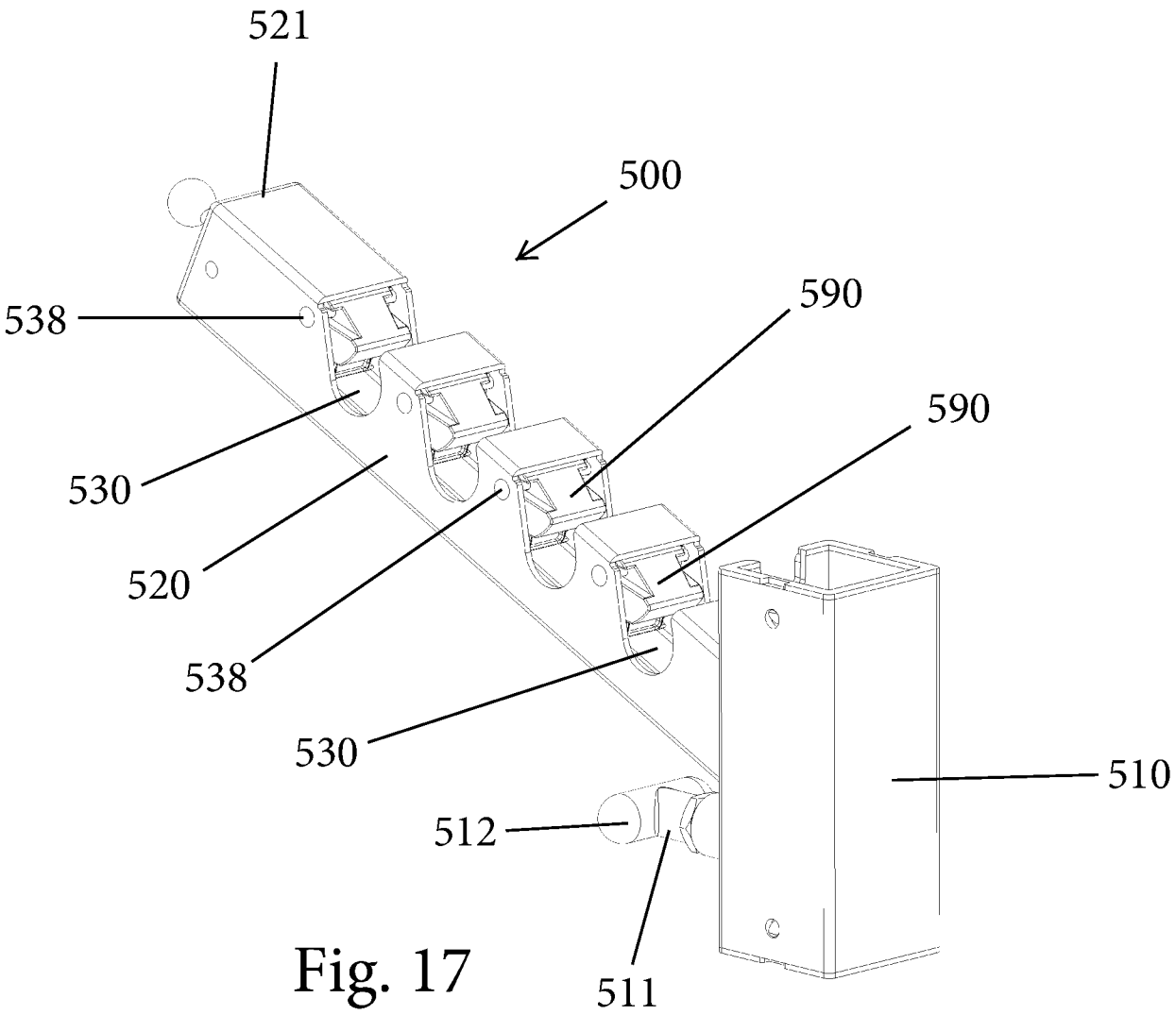
FIG. 17 is a perspective view of a bar support assembly in an assembled state.
Figure 18:
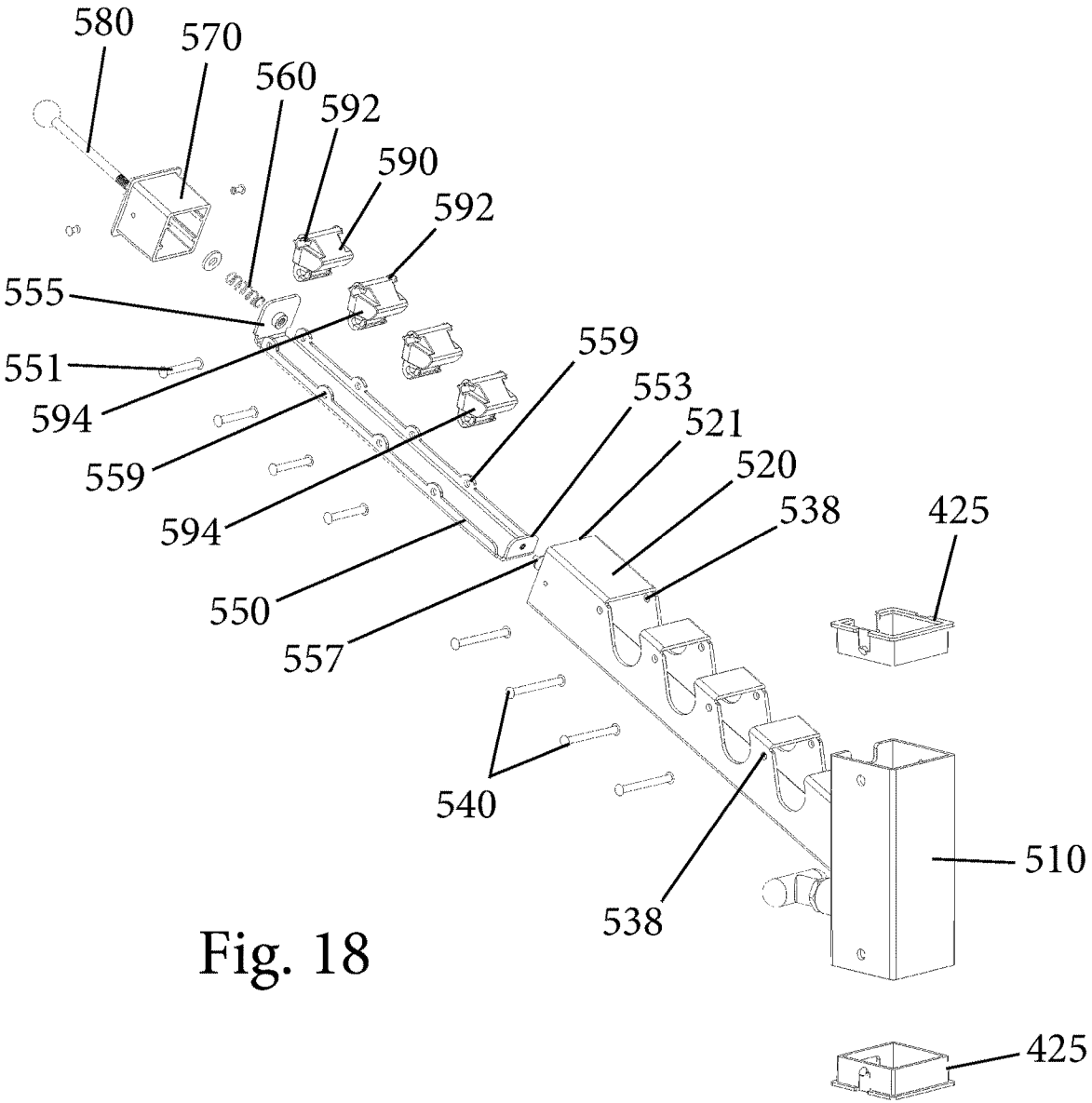
FIG. 18 is an exploded perspective view of the bar support assembly.

FIGS. 14A-14C illustrate a horizontal slot concept as a means for engaging the ends of the exercise bar 10 to the upright frame members 200. The exercise bar 10 can be inserted into horizontal slots 205 formed in the upright frame members 200 at the pole attachment locations. The exercise bar 10 can be in the form of a bar within a tube allow the outer section to rotate during exercise. The exercise bar 10 includes hooks 15 at ends of the exercise bar 10 that are inserted into the horizontal slots 205.

Telescoping Adjustment

Figure 10:
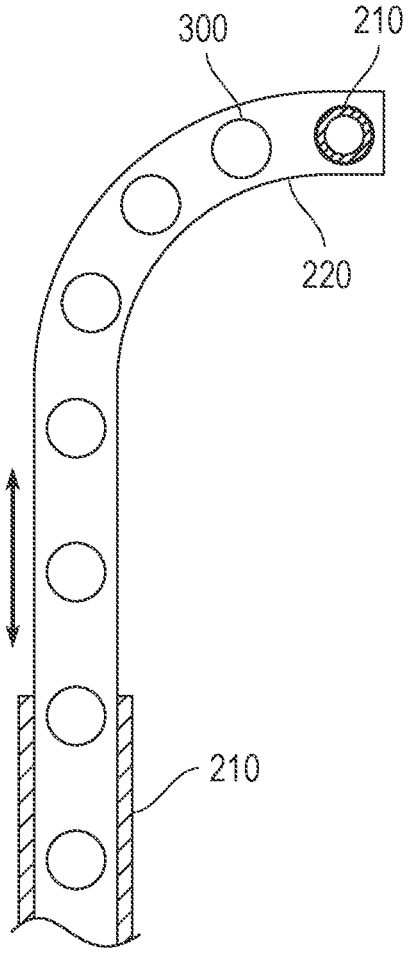
FIG. 10 is a view showing a telescoping upright frame member.

In one embodiment shown in FIG. 10, the upper section 220 can be fitted to the lower section 210 in a telescoping manner in that the upper section 220 can be moved up and down relative to the lower section 210. This allows the overall height of the upright frame members 200 to be changed depending upon the height of the user and other factors. The upper section 220 can be locked in place relative to the lower section 210 using conventional techniques such as locking pins or a set screw or the like. This allows easy adjustment of the upper sections 220 relative to the lower section 210.

In one embodiment, the height is adjustable in ½ inch increments.

It will also be appreciated that the exercise device 100 can be used to perform other exercises as well.

As discussed, the exercise device 100 allows the user to perform an incline push-up of varying and selectable difficulty and as the user becomes stronger and more accustomed to performing push-ups, the user can ultimately graduate to performing traditional push-ups on a horizontal ground plane.

Exercise Device (Second Embodiment)

FIGS. 15-21 illustrate an exercise device 400 (piece of exercise equipment) according to another embodiment. The exercise device 400 is intended to be a freestanding structure that can be positioned in a residential setting (a room in a house) or it can be positioned in a commercial setting, such as a gym. The exercise device 400 thus has a frame 401 that allows it to stand upright on a floor (ground surface).

Frame 401

The frame 401 includes a base 402 that is configured to rest on the ground. The base includes a first support bar 404 (horizontal bar) and a second support bar 406 (horizontal bar) that are spaced in parallel relationship. The first and second support bars 404, 406 are elongated structures. To maintain the parallel spaced relationship of the first and second support bars 404, 406, a spacer bar 408 can be provided. The spacer bar 408 is an elongated structure and is a cross bar since it extends between (across) the first support bar 404 and the second support bar 406. As shown, the spacer bar 408 is attached to the first support bar 404 and the second support bar 406 near rear ends 409 thereof. At a first end, the spacer bar 408 is attached to the first support bar 404 with a bracket 410 and is attached, at its second end, to the second support bar 406 with another bracket 410. The brackets 410 are mounted to the first and second support bars 404, 406 using fasteners (e.g., screws). At the rear end and a front end of each of the first and second support bars 404, 406 is an end cap 413. The attachment of the spacer bar 408 to the first and second support bars 404, 406 maintains not only the spacing between the first and second supports bars 404, 406 but also adds stability to the frame 401.

The frame 401 also includes a bar of vertical support bars (upright frame supports) 420 that are attached to the first and second support bars 404, 406. As shown, the vertical support bars 420 are attached at their bottom ends to the first and second support bars 404, 406. Each vertical support bar 420 has openings 429 formed therein that are at least open along the front face thereof.

In the illustrated embodiment, each vertical support bar 420 is actually formed of two bars that are attached to one another using vertical connector 427. The two bars can have the same length as shown or can have different lengths.

Each vertical support bar 420 can be attached using a bracket 430 that comprises first and second stability plates 432. The first stability plate 432 is located along the outer side (outer face) of the respective support bar 404, 406 and the second stability plate 432 is located along the inner side (inner face) of the respective support bar 404, 406. The vertical support bar 420 is thus located between the first and second stability plates 432. Each of the first and second stability plates 432 is generally triangular shaped with a bottom flat edge for placement at or proximate the ground surface. A front edge of the stability plates 432 is contoured to include a plurality of notches 425 that define lower pole positions as described herein. The notches 425 are thus located on a slope with the forward most notch 425 defining the lowest pole position. Fasteners 426 can be used to attach the stability plates 432 to both the first and second support bars 404, 406 and to the vertical support bars 420. Upper holes formed in the plates 432 receive fasteners 426 to attach the vertical support bar 420 to the stability plates 432, while lower holes formed in the plates 432 receive fasteners 426 to attach the respective plates 432 to the respective support bar 404, 406.

The shapes of the notches 425 can differ so long as they are complementary to the bar being received therein. The notches 425 are designed so that when the bar is received in the pair of opposing notches 425, the (pole) bar is stable and the user can apply his or her weight on the bar without and slippage of the bar.

At the tops of each of the vertical support bars 420, there is a top bracket 440 to which a top bar (cross bar) 450 is attached. The top bar 450 thus extends across (between) the two spaced apart vertical support bars 420. This provides even more stability to the frame 401.

The first and second stability plates 432 thus are multipurpose in that they are part of the structural assembly and also they provide additional pole positions close to the ground and define the most difficult pole positions.

One feature of the exercise device 400 is that a timer 460 can be provided and can be mounted to one of the vertical support bars 420. The electronic timer 460 can be attached to a timer mounting bracket 462 that can be detachably coupled to the vertical support bar 420 using a pin or the like, such as a spring loaded pin. The electronic timer 460 can thus be adjusted along the height of the vertical support bar 420 and therefore accommodates users of different height and/or different preferences for timer location. To adjust the location of the electronic timer 460, the user can simply pull out the pin from an opening in the vertical support bar 420 and then move the timer mounting bracket 462 to another opening in the vertical support bar 420 through which the pin passes.

Bar Support Assembly 500

In accordance with the present disclosure, the exercise device 400 includes a pair of bar support assemblies 500 each of which is vertically adjustable along one of the vertical support bars 420. Each bar support assembly 500 includes a hollow base sleeve 510 that is configured to receive the vertical support bar 420 such that the hollow base sleeve 510 is able to move vertically along the vertical support bar 420 to a desired position. Once the desired position is reached, the hollow base sleeve 510 is locked in place. The hollow base sleeve 510 can include a spring biased pin 511 that terminates in a handle 512. The pin engages one of the openings 429 formed in the front face of the vertical support bar 420. The spring biased pin 511 can be of a type such that it can lock in the retracted position. By locking the spring biased pin in a retracted (disengaged) position, the user can then go over to the other bar support assembly 500 and unlock that hollow base sleeve 510 to then permit both bar support assemblies 500 to move in unison vertically along the vertical support bars 420.

Sleeve inserts 425 can be provided and inserted into the hollow interior of the hollow base sleeve 510.

An arm 520 extends radially outward from the hollow base sleeve 510. The arm 520 can be integrally formed with the hollow base sleeve 510. The arm 520 extends at an angle other than 90 degrees relative to the longitudinal (vertical) axis of the hollow base sleeve 510. The arm 520 is a hollow structure that is includes a first side wall, an opposing second side wall and a floor that extends between the first side wall and the second side wall. A first (distal) end 521 of the arm 520 is an open end, while an opposite second (proximal) end 523 of the arm 520 is a closed end in that this end is closed by the hollow base sleeve 510. The arm 520 also includes a plurality of notches 530 that, as described herein, are designed to receive the exercise bar 10. Each notch 530 is defined by a notch formed in the first side wall and a corresponding notch formed in the second side wall. Each notch 530 has a curved bottom edge 533.

The illustrated arm 520 includes four notches 530 that are spaced apart a uniform distance. It will be appreciated that there can be more or less than four notches 530 formed in the arm 520. Since the arm 520 is set at an incline, the notches 530 are likewise set at an incline. The arm 520 also includes a plurality of holes 538 and more specifically, there are four sets of holes 538 with each set defined by one hole 538 formed in the first side wall and another hole 538 formed in the second side wall opposite the one hole 538. The holes 538 are formed close to the top edge of the first side wall and the second side wall. The holes 538 are also formed at the leading edge of the notch 530 with the leading edge being the edge closer to the first end 521 of the arm 520. As described herein, a plurality of first pins 540 are received within the sets of holes 538 and extend across the hollow interior of the arm 520 from the first side wall to the second side wall.

A sliding insert (U-link) 550 is disposed within the hollow center of the arm 520. The insert 550 is an elongated structure with a first end 552 and a second end 554. The insert 550 has a floor and first and second upstanding side walls that extend upwardly from the floor. At the first end 552, there is a first upstanding tab 553 and at the second end, there is a second upstanding tab 555. The first upstanding tab 553 serves as an anchor wall to anchor a bumper 557. The bumper 557 faces the hollow base sleeve 510. Along the side walls, there is a plurality of holes 559 and more specifically, there are four sets of holes 559 with each set defined by one hole 559 formed in the first side wall and another hole 559 formed in the second side wall opposite the one hole 559. The number of holes 559 equals the number of holes 538. As described herein, a plurality of second pins 551 pass through the holes 559 with one second pin extending with one set of holes 559. The function of the second pins 551 is described below.

The insert 550 is biased by a biasing element 560, such as a spring. The spring 560 is disposed between the second upstanding tab 555 and an end cap 570 that is disposed within the open first end 521 of the arm 520. In other words, one end of the spring 560 contacts the second upstanding tab 555 and the other end contacts the inner wall of the end cap 570. The spring 560 is designed to apply a force to the insert 550 such that the insert 550 is pushed downward within the arm 520 toward the hollow base sleeve 510. In this initial position (FIG. 19), the bumper 557 is in contact with the wall of the hollow base sleeve 510.

A release knob 580 is provided and is coupled to the second upstanding tab 555 as by using a nut or the like. The release knob 580 has an elongated shaft (which can include a threaded portion) and a knob at the opposite end that can be grasped by the user to pull the knob 580 outward. The release knob 580 thus passes through an opening formed in the end cap 570 and through the center of the spring 560 to the second upstanding tab 555. It will be appreciated that when the user pulls the release knob 580 outward, the spring 560 compresses and stores energy and when the user releases the knob 580, the spring 560 drives the insert 550 downward within the arm 520 to the initial rest position of FIG. 19.

A plurality of lock pieces 590 are provided with one lock piece 590 being disposed within one corresponding notch 530. As described herein, each lock piece 590 is pivotally coupled to both the arm 520 and the insert 550 and moves between an unlocked position in which the bar 10 can be inserted into the notch 530 and a locked position in which the bar 10 is locked in place.

As shown, each lock piece 590 comprises an angled body that has a first through hole 592 that is located at or near the top of the lock piece 590 and receives one first pin 540 to pivotally couple the lock piece 590 to the body of the arm 520. A second through hole 594 is formed in the angled body at or near the bottom of the lock piece 590 and receives one second pin 551 to pivotally couple the lock piece 590 to the insert 550. Since the lock piece 590 is coupled to both the arm 520 and the insert 550, the bottom of the lock piece 590 moves with the sliding action of the insert 550, while the top of the lock piece 590 pivots relative to the fixed arm 520.

Figure 19:
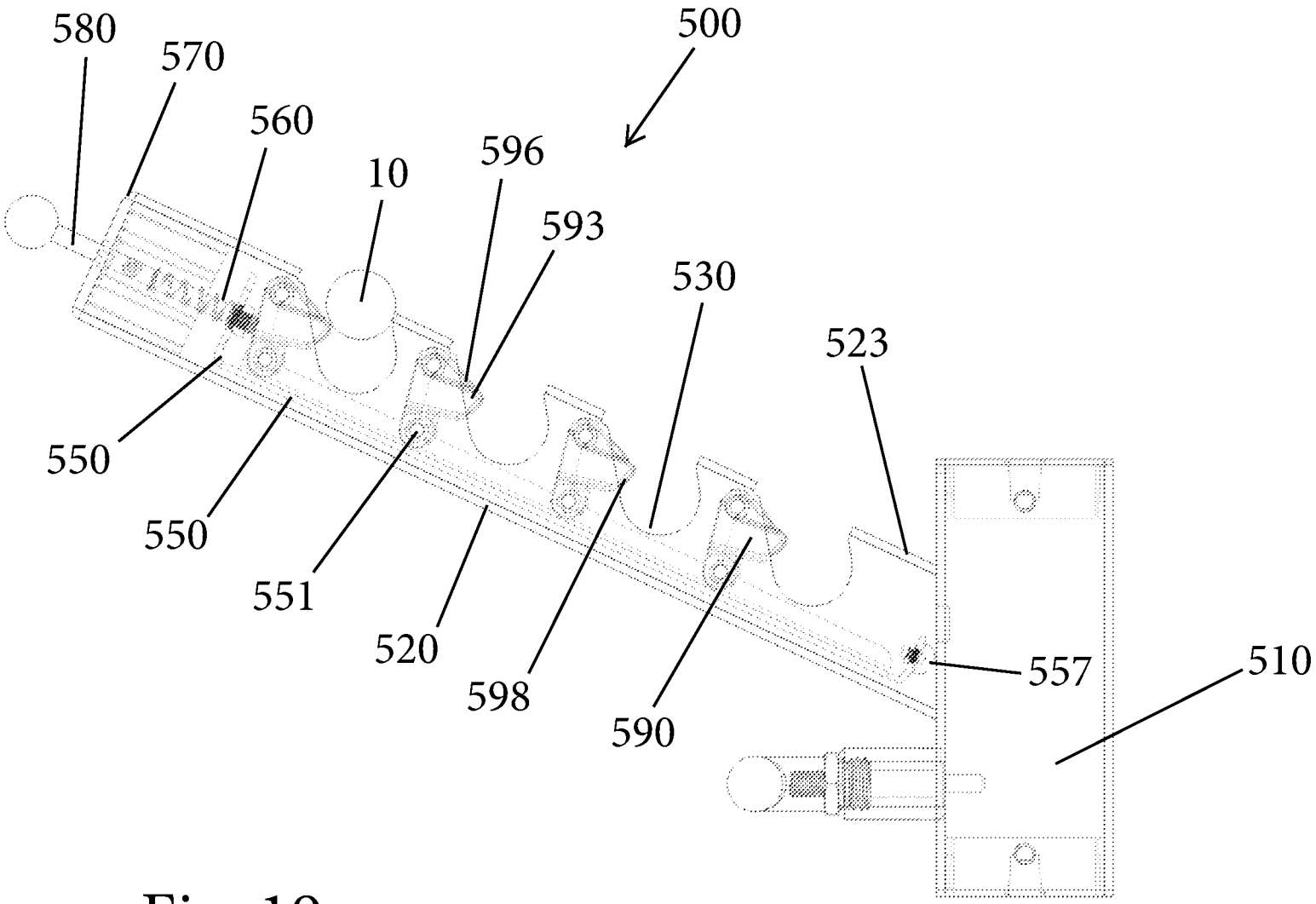
FIG. 19 is a side elevation view of the bar support assembly in partial transparency to show the inner working components in a first bar position.

The lock piece 590 includes a top angled surface 596 and a bottom angled surface 598 with the top angled surface 596 and the bottom angled surface 598 intersecting at a point 593. As shown in FIG. 19, the top angled surface 596 and bottom angled surface 598 are located within the notch 530.

As described herein, the moving lock piece 590 is desired to receive and then lock the exercise bar 10 in place.

Figure 20:
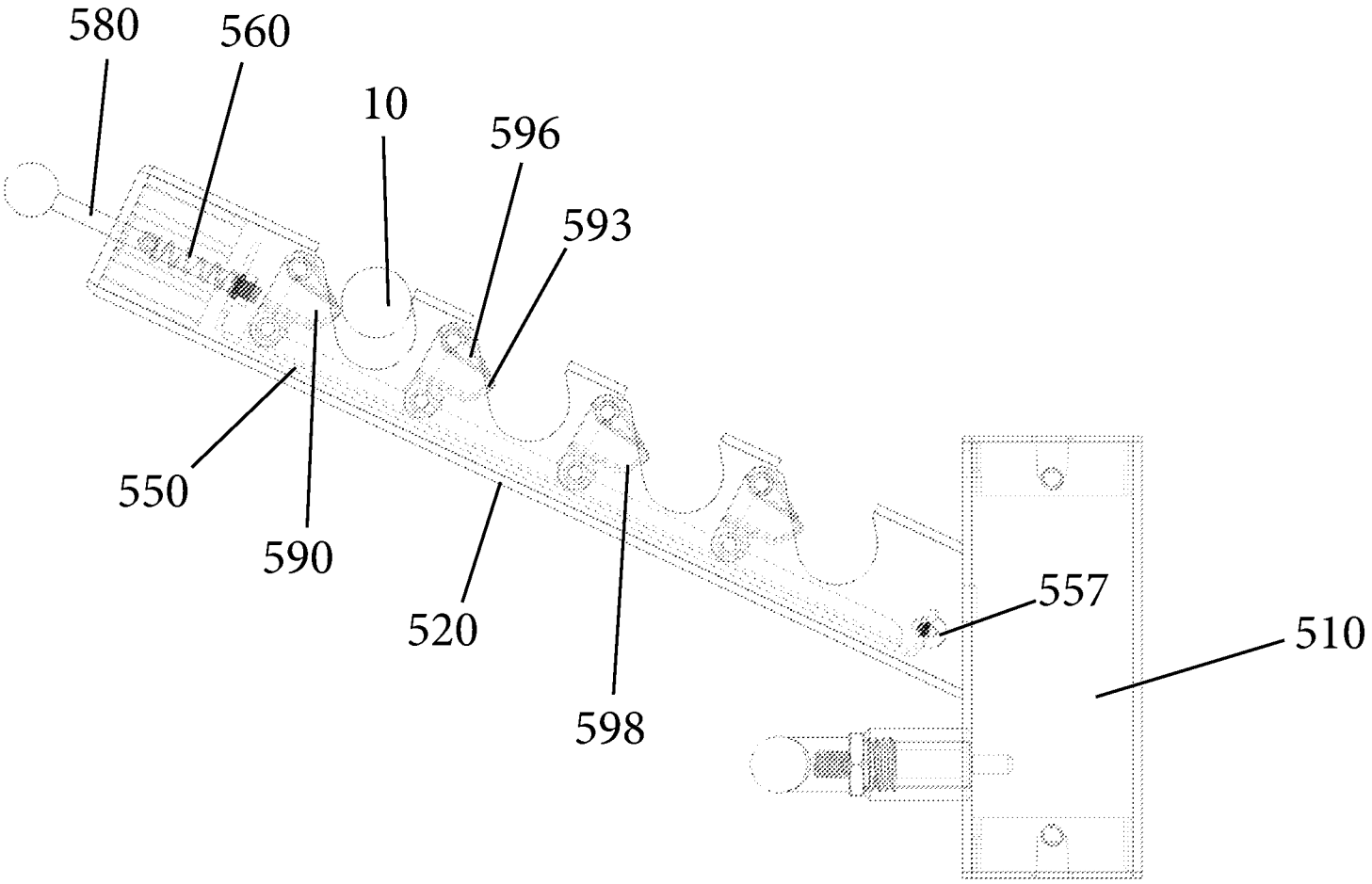
FIG. 20 is a side elevation view of the bar support assembly in partial transparency to show the inner working components in a second bar position.

FIG. 19 shows the initial at rest position in which the spring 560 forces the insert 550 downward against the hollow base sleeve 510 with the bumper 557 seating against the wall of the hollow base sleeve 510. In the initial position, the exercise bar 10 lies above the lock piece 590 and has not entered the notch 530. To insert and lock the bar 10 in place with a select one of the notches 530, the user positions the bar 10 above the top angled surface 596. As shown in FIG. 19, the diameter of the bar 10 is greater than the distance between the point 593 and the trailing wall of the notch 530 and thus, the bar 10 cannot simply drop into the notch 530. Instead, as the bar 10 is lowered into the notch 530, the bar 10 makes contact with the top angled surface 596 and as the bar 10 is pushed into the notch 530, the insert 550 moves in an outward direction away from the hollow base sleeve 510 as shown in FIG. 20. The bumper 557 thus no longer is in contact with the wall of the hollow base sleeve 510. At the same time, the lock piece 590 pivots relative to the arm 520 as shown. As shown in FIG. 20, the lock piece 590 has pivoted downward. FIG. 20 is an intermediate position in which the bar 10 is partially within the notch 530 and lies between the point 593 and the trailing wall of the notch 530.

Figure 21:
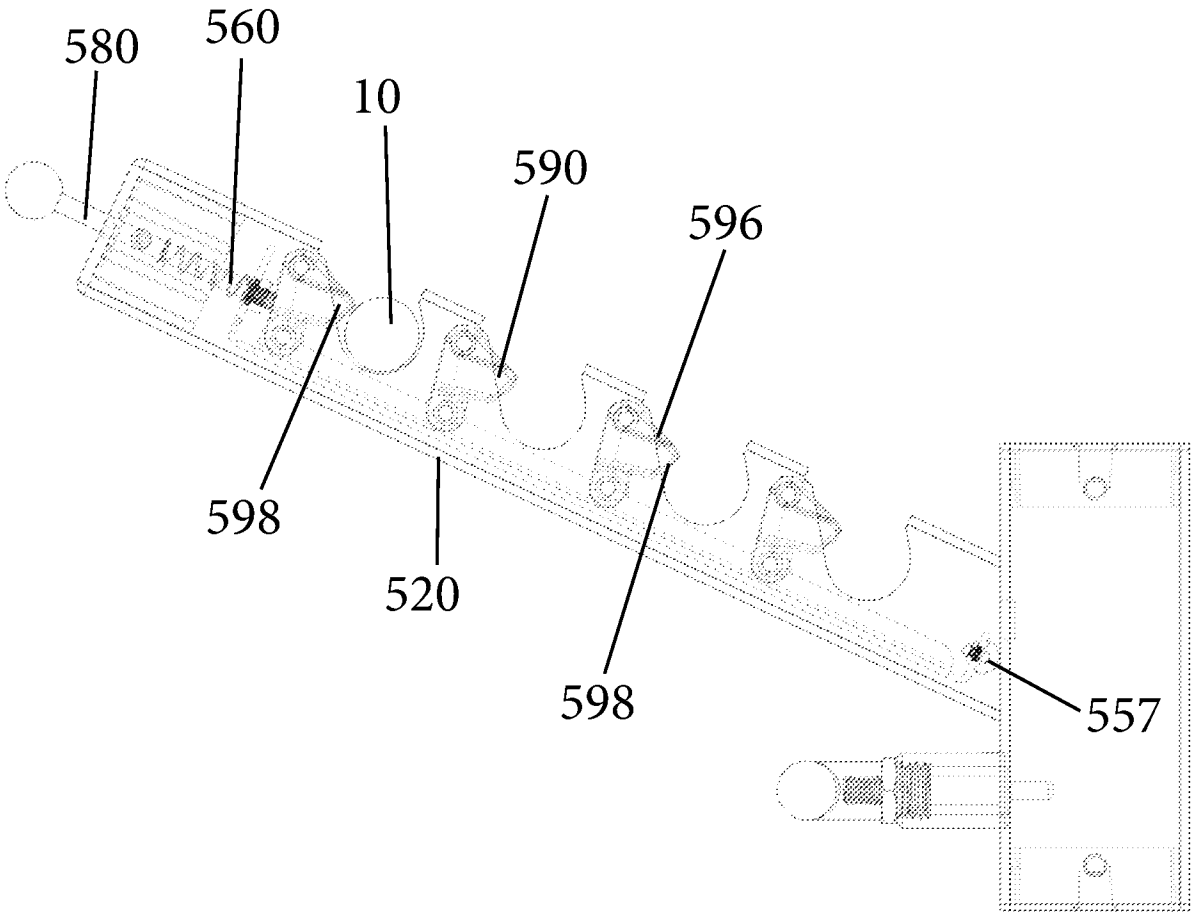
FIG. 21 is a side elevation view of the bar support assembly in partial transparency to show the inner working components in a third bar position.

FIG. 21 illustrates the final locked position of the bar 10 which the bar 10 is fully inserted into the notch 530 and rests against the bottom edge of the notch 530. In this position, the lock piece 590 has assumed a locked position in which the ball 10 is now in contact not with the top angled surface 596 but instead is now in contact with the bottom angled surface 598. This bottom angled surface 594 lies above the bar 10 and thus, prevents the bar 10 from being removed from the notch 530. The pivot locations of the lock piece 590 prevent the upward movement of the lock piece 590 as if the lock piece 590 was being removed. The lock piece 590 effectively traps the bar 10 in the notch 530. As shown in FIG. 21, the insert 550 has returned to the initial at rest position in which the bumper 557 seats against the wall of the hollow base sleeve 510 and the lock piece 590 is in the initial position as in FIG. 19 with the difference being the bar 10 is now below and in contact with the bottom angled surface 598 resulting in the lock piece 590 being locked in place.

To release the bar 10 from this locked position of FIG. 21, the release knob 580 is pulled outward causing the spring 560 to compress and also increases the distance between the point 593 and the trailing edge of the notch 530 such that this distance is greater than the diameter of the ball 10 (See, FIG. 20). This positioning of the lock piece 590 allows the bar 10 to be freely removed from the notch 530.

As with the first embodiment, the exercise device 400 is designed so that the user can perform incline push ups of increasing difficulty as the bar 10 is initially lowered within the notches 530 of the arm 520. Once the user has stepped through each of the notches 530, the user can then use brackets that are attached to the vertical support bar 420 that hold the bar 10. The user then can lower the bar 10 along the vertical support bar 420 toward the ground floor. The final positions for the bar 10 are the notches 425 formed in the plates 432. As mentioned, the notches 425 are formed along an incline and therefore, the highest notch 425 represents the easiest level of the notches 425, while the lowest notch 425 represents the most difficult level of the notches 425 since this lowest notch 425 is almost on the ground.

The assemblies 500 can be raised or lowered along the vertical supports bars 420 to accommodate the height of the user.

The biasing mechanism of the insert 550 thus ensures that the insert 550 is by default in the locked position in which the insert 550 is fully retracted within the arm 520. To release the locked bar 10, the release knob is pulled outward causing an upward sliding movement of the insert 550 within the arm 520, thereby freeing the lock pieces 590 from contact with the bar 10 and allowing removal of the bar 10.

It will also be appreciated that the embodiment shown in FIGS. 16-21 can be designed without the locking mechanisms 590. In this embodiment, the bar can be simply inserted into one respective notch formed in the arm 520 and held in place by gravity as opposed to using the locking mechanisms 590. The arm 520 without the locking mechanism thus is still attached to and extends outwardly from the hollow base sleeve 510 which allows for vertical adjustment of the arm along the main vertical frame as discussed herein. In this embodiment, the notches 425 are still maintained in the stability plates 432 and provide lower areas for bar insertion.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. An exercise device for performing incline push-ups comprising:

a base; and a pair of upright frame members connected at their bottoms to the base;

a pair of bar support assemblies that movably travel along the upright frame members, each bar support assembly including a hollow base sleeve that surrounds one upright frame member and an arm that extends outwardly from the hollow base sleeve at an angle, the arm having a plurality of spaced notches formed therein, the bar support assembly including an insert that slidingly travels within the hollow interior of the arm, the insert being biased by a biasing element that is disposed between the arm and the insert, the insert being biased in a direction toward the hollow base sleeve, the bar support assembly further including a plurality of lock pieces that are pivotally attached to both the arm and the insert, each lock piece being disposed at least partially within one respective notch of the arm and movable between an unlocked position and a locked position.

2. The exercise device of claim 1, wherein each notch has a leading edge that is further from the hollow base sleeve and a trailing edge that is closer to the hollow base sleeve, wherein the respective lock piece is disposed along the leading edge of the respective notch.

3. The exercise device of claim 1, wherein the insert has a first bent end and an opposing second bent end, the biasing element being disposed between the first bent end and the arm, while the second bent end includes a bumper that contacts the hollow base sleeve when the insert is in a fully retracted position.

4. The exercise device of claim 3, wherein each lock piece is pivotally coupled to the arm by a first pin and the lock piece is pivotally coupled to the insert by a second pin.

5. The exercise device of claim 4, wherein the first pin is above the second pin.

6. The exercise device of claim 1, wherein each lock piece has a top angled surface and a bottom angled surface that intersects the top angled surface at a point.

7. The exercise device of claim 6, wherein in the unlocked position, a distance between the point and a trailing edge of the notch is greater than a distance between the point and the trailing edge of the notch in the locked position.

8. The exercise device of claim 1, further including a release knob that is fixedly coupled to the insert by a shaft with the biasing element comprises a spring that is disposed about the shaft.

9. The exercise device of claim 8, further including an end cap that is inserted into an open outer end of the arm, the end cap having an opening through which the shaft passes and the spring being disposed between an inner face of the end cap and an outer end of the insert.

10. The exercise device of claim 1, wherein the base is attached to the pair of upright frame members with a pair of stability plate assemblies, each stability plate assembly including a plurality of inclined notches for receiving an exercise bar.

11. The exercise device of claim 10, wherein the base includes a first base support and a second base support that is spaced from the first base support and is parallel thereto, wherein each stability plate assembly includes an outer stability plate and an inner stability plate that are attached to opposite sides of a respective one of the first base support and the second base support with one upright frame member being attached to and disposed between the outer stability plate and the inner stability plate.

12. An exercise device for performing incline push-ups comprising:

a base;

a pair of upright frame members connected at their bottoms to the base; and a pair of bar support assemblies that movably travel along the upright frame members, each bar support assembly including a hollow base sleeve that surrounds one upright frame member and an arm that extends outwardly from the hollow base sleeve at an angle, the arm having a plurality of spaced notches formed therein for receiving an exercise bar;

wherein the base is attached to the pair of upright frame members with a pair of stability plate assemblies, each stability plate assembly including a plurality of inclined notches for receiving the exercise bar and positioning the exercise bar at different distances from a ground surface.

13. The exercise device of claim 12, wherein the base includes a first base support and a second base support that is spaced from the first base support and is parallel thereto, wherein each stability plate assembly includes an outer stability plate and an inner stability plate that are attached to opposite sides of a respective one of the first base support and the second base support with one upright frame member being attached to and disposed between the outer stability plate and the inner stability plate.

14. The exercise device of claim 12, wherein the first base support and the second base support are perpendicular to the pair of upright frame members and wherein the first base support and one respective upright frame member are located between one inner stability plate and one outer stability plate.

* * * * *